US007572216B2

(12) United States Patent
Harding

(10) Patent No.: US 7,572,216 B2
(45) Date of Patent: Aug. 11, 2009

(54) DUNNAGE CONVERSION MACHINE AND OUTPUT CHUTE GUARD

(75) Inventor: Joseph J. Harding, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 11/816,841

(22) PCT Filed: Feb. 22, 2006

(86) PCT No.: PCT/US2006/006549

§ 371 (c)(1),
(2), (4) Date: Aug. 22, 2007

(87) PCT Pub. No.: WO2006/091789

PCT Pub. Date: Aug. 31, 2006

(65) Prior Publication Data

US 2008/0200325 A1 Aug. 21, 2008

Related U.S. Application Data

(60) Provisional application No. 60/655,090, filed on Feb. 22, 2005.

(51) Int. Cl.
*B31B 1/00* (2006.01)

(52) U.S. Cl. ..... 493/464; 493/404; 493/967

(58) Field of Classification Search ..... 493/464, 493/404, 967, 38

See application file for complete search history.

(56) References Cited

U.S. PATENT DOCUMENTS 5,906,569 A 5/1999 Ratzel et al.
5,989,176 A * 11/1999 Ratzel et al. ..... 493/464
6,416,451 B1 * 7/2002 Ratzel et al. ..... 493/38
2002/0082152 A1 6/2002 Manley

FOREIGN PATENT DOCUMENTS

WO 95/28276 A 10/1995
WO 98/00288 A 1/1998

OTHER PUBLICATIONS

International Search Report of International Application No. PCT/US2006/006549, filed Feb. 22, 2006; published as International Publication No. WO 2006/091789 A2.

* cited by examiner

*Primary Examiner*—Hemant M Desai
(74) *Attorney, Agent, or Firm*—Renner, Otto, Boisselle & Sklar, LLP

(57) ABSTRACT

A dunnage conversion machine (10) has an output chute (60) with a guard (70) that inhibits access to internal areas of the machine (10) through the output chute (60). Upstream of the output chute (60) the conversion machine (10) has a conversion assembly (16) that converts a stock material (14) into a strip of dunnage (20) as the stock material passes therethrough in a downstream direction. The output chute (60), through which the strip of dunnage (20) is discharged downstream of the conversion assembly (16), includes the pivotably-mounted guard (70) extending into the chute (60). The guard (70) has at its free end (72) both a forward glide surface (74) operative to glide along an outer surface of the strip of dunnage (20) as the strip moves in the downstream direction and a rearward glide surface (76) operative to glide along an outer surface of the strip of dunnage (20) as the strip moves in an upstream direction opposite the downstream direction.

13 Claims, 3 Drawing Sheets

DUNNAGE CONVERSION MACHINE AND OUTPUT CHUTE GUARD

This application claims the benefit of International Patent Application No. PCT/US2006/006549, filed Feb. 22, 2006, published in English as International Publication No. WO 2006/091789 A2, which claims the benefit of U.S. Provisional Patent Application No. 60/655,090, filed Feb. 22, 2005, both of which are hereby incorporated herein.

FIELD OF THE INVENTION

The present invention relates to dunnage converters that convert stock material into a dunnage product, and more particularly, to an output chute guard for a dunnage conversion machine that allows the dunnage product to exit the machine but inhibits access through the chute from an open end of the chute.

BACKGROUND

In a dunnage converter a conversion assembly typically advances a stock material through the converter in a downstream direction, forming a dunnage product as the stock material passes through a conversion assembly. The leading end of a strip of dunnage typically exits the converter through an output chute that temporarily supports the strip until a section is separated from the strip to form a discrete dunnage product. In certain circumstances, such as a jam in the converter, for example, operating the converter in reverse can be helpful to clear the jam by backing the strip of dunnage through the chute in an upstream direction opposite the downstream direction.

To block foreign objects from passing through the chute in the upstream direction, however, the chute can be equipped with a shield. An exemplary cushioning conversion machine and several embodiments of output chute shield mechanisms are disclosed in the international patent application published in English under Publication No. WO 98/00288, on Jan. 8, 1998. Although prior output chute shield mechanisms perform adequately in many situations, it would be desirable to further inhibit access through a chute from a downstream end in an upstream direction.

SUMMARY

The present invention provides a dunnage conversion machine having an output chute with an improved guard that is difficult to open from a downstream end of the chute when the guard is in a closed position.

More particularly, the present invention provides a dunnage converter that includes an output chute through which a strip of dunnage is discharged. The converter includes a conversion assembly that converts a stock material into a strip of dunnage as the stock material passes therethrough in a downstream direction. The output chute is downstream of the conversion assembly, and a guard disposed in the chute. The guard is movable between an open position allowing passage of the strip of dunnage through the chute and a closed position inhibiting access to an upstream end of the chute from the downstream end of the chute. At its free end, the guard has both a forward glide surface operative to glide along an outer surface of the strip of dunnage as the strip moves in the downstream direction and a rearward glide surface operative to glide along an outer surface of the strip of dunnage as the strip moves in an upstream direction opposite the downstream direction.

The free end of the guard can have curved glide surfaces. When the guard is in a closed position where the free end is adjacent the sidewall of the chute, a downstream-most point of the upstream and downstream glide surfaces is inaccessible from a downstream end of the chute. In this closed position, with the free end adjacent the sidewall of the chute, the free end of the guard generally parallels the adjacent surface of the sidewall. The chute can also include a deflector that extends into the chute upstream of the guard to deflect the strip of dunnage toward a center of the chute.

The chute can also include an upstream-facing shoulder that defines a recess upstream of the shoulder that allows the free end of the guard to move to a position where the rearward glide surface is inaccessible from a downstream end of the chute. A curb that projects into the chute can form the shoulder and the recess upstream of the curb.

The present invention further provides a dunnage converter that includes a conversion assembly and an output chute through which a strip of dunnage is discharged downstream of the conversion assembly. The output chute in such a converter includes a guard that has a free end that is inaccessible from a downstream end of the chute when the guard is in a closed position.

The following description and the annexed drawings set forth in detail illustrative embodiments of the invention, which are indicative, however, of but a few of the various ways in which the principles of the invention can be employed.

DETAILED DESCRIPTION

Figure 1:
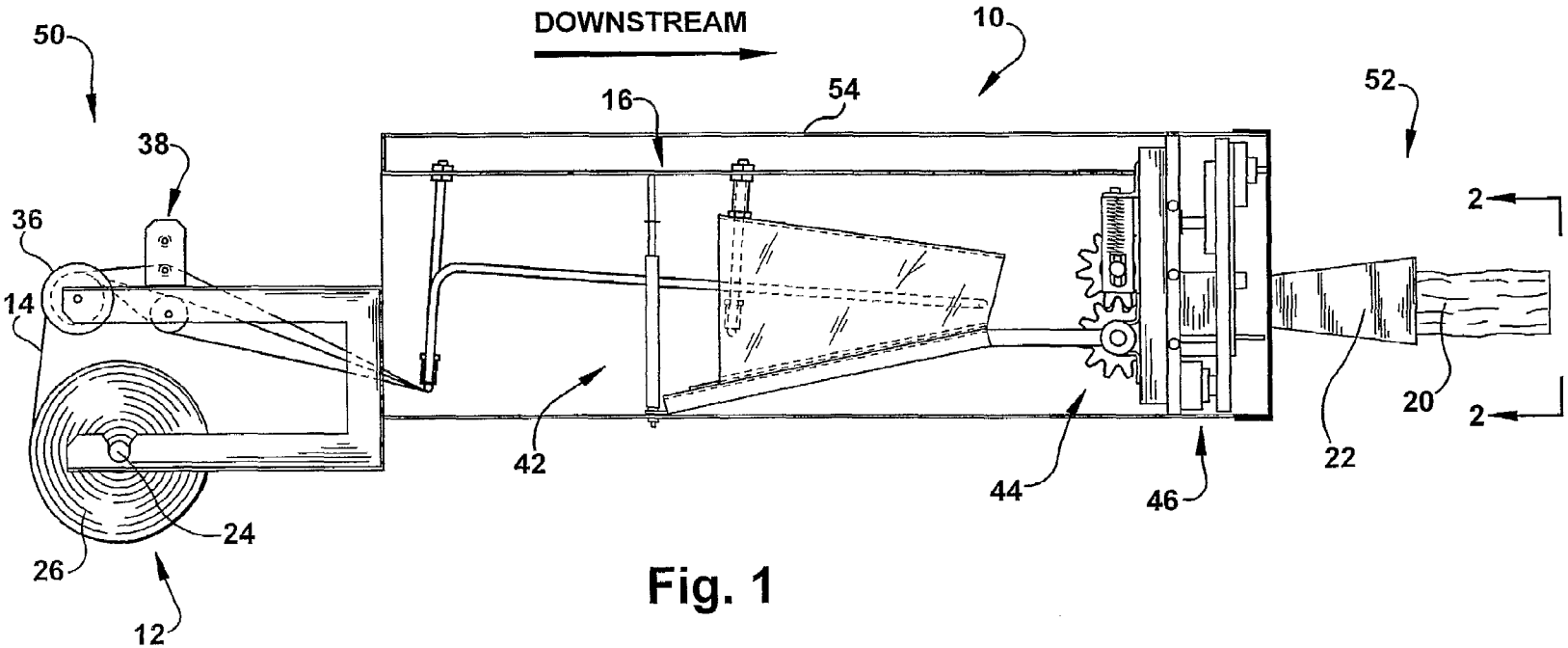
FIG. 1 is a schematic sectional view of a dunnage conversion machine with an output chute according to the invention.

Referring now to the drawings in detail, FIG. 1 shows an exemplary dunnage conversion machine 10, also referred to as a dunnage converter, in accordance with the present invention. The converter 10 includes a stock supply assembly 12 that includes a sheet stock material 14, a conversion assembly 16 that converts the sheet stock material into a strip of dunnage 20 as the stock material moves through the conversion assembly in a downstream direction, and an exit or output chute 22 downstream of the conversion assembly.

The stock material supply 12 can include a suitable holder 24 toward an upstream end of the converter 10 for a supply of sheet material 14 for conversion into a dunnage product. The stock material, which can be in the form of a fan-folded stack or a roll of wound stock material 26, typically has one or more plies of sheet material. A multi-ply sheet stock material 14 is shown in the illustrated embodiment. One or more of the plies can be made of paper, such as printed paper, bleached paper, thirty or fifty pound weight kraft paper, etc., or combinations thereof. Other types of sheet material also can be suitable.

The sheet stock material 14 typically is fed past a constant entry guide or roller 36 before entering the converter 10. From the constant entry guide, the plies of the illustrated multi-ply sheet stock material are separated as they pass through a separating assembly 38 to the conversion assembly 16.

The conversion assembly 16 in the converter 10 shown in FIG. 1 includes a forming assembly 42, a feeding assembly 44 and a severing assembly 46. The forming and feeding assemblies convert the sheet stock material 14 into a relatively less dense, three-dimensional dunnage product. The feeding assembly 44 advances the sheet stock material through the forming assembly 42 from an upstream end 50 of the machine 10 toward a downstream end 52 of the machine 10. As the stock material advances, the forming assembly 42 turns lateral portions of the sheet stock material inwardly to shape the strip of dunnage. The feeding assembly 44 pulls the stock material from the supply assembly 12 for passage through the forming assembly 42. The illustrated feeding assembly 44 also connects the layers of stock material in the formed strip downstream of the forming assembly to help the strip maintain its shape, and then feeds the strip through the output chute 22. The severing assembly 46 upstream of the output chute 22 severs discrete dunnage products, commonly referred to as pads, from the strip.

Further details of exemplary dunnage converters and their components are described in U.S. Pat. Nos. 4,699,609; 5,123,889; 5,755,656; 6,174,273; 6,200,251; 6,203,481; 6,210,310; 6,277,459; 6,387,029; 6,468,197; and 6,491,614 and other patents assigned to Ranpak Corp. of Concord Township, Ohio, U.S.A. The present invention is not limited to such converters, however, but could be used with other types of dunnage converters as well.

The converter 10 generally includes a housing 54 in which the conversion assembly 16 is mounted. At the right in FIG. 1, the end of the output chute 22 can be seen with a strip of dunnage 20 or a dunnage product extending from the chute for collection by an operator.

Figure 2:
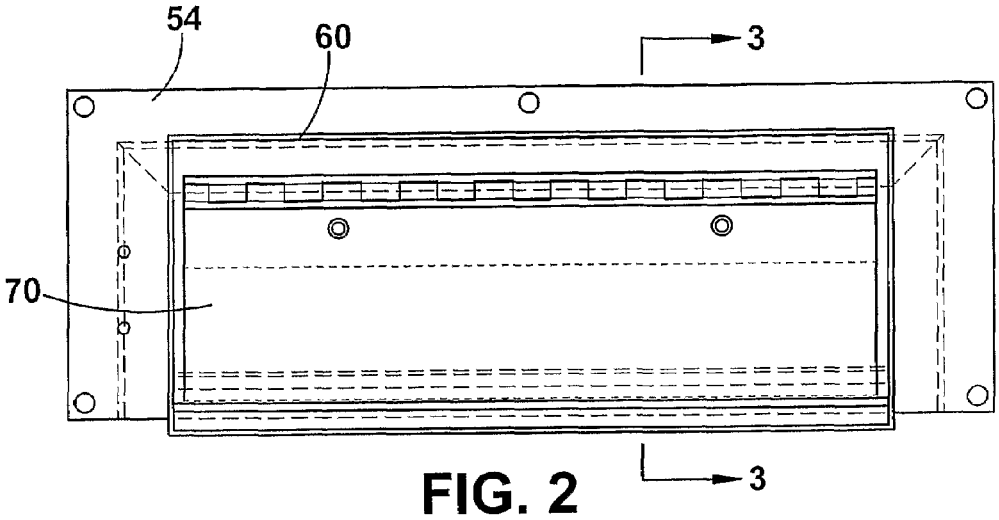
FIG. 2 is an enlarged end view of the output chute of FIG. 1 looking from line 2-2 of FIG. 1 with the dunnage strip removed.
Figure 3:
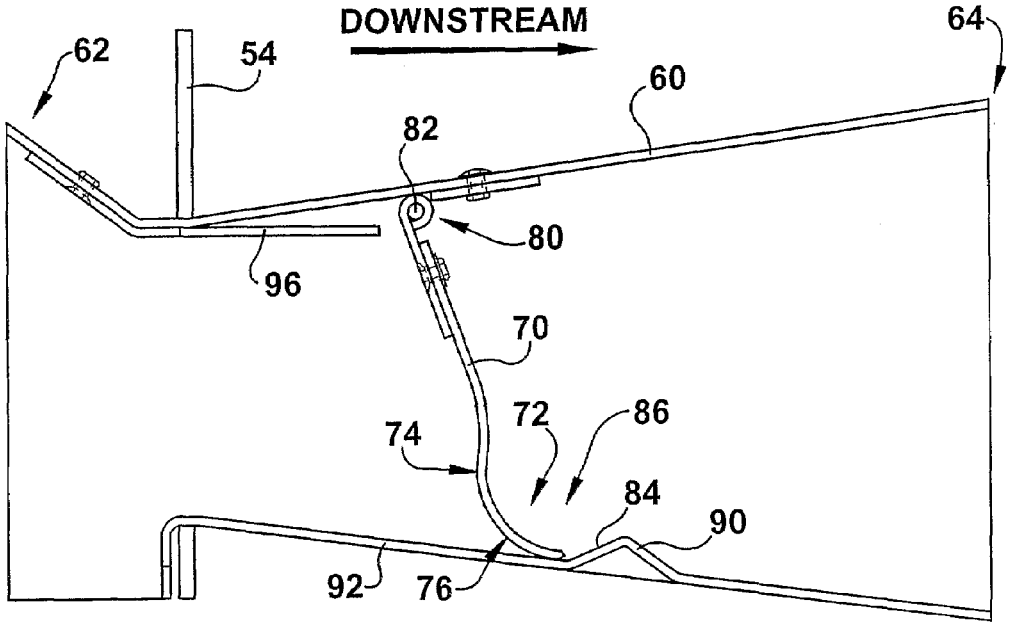
FIG. 3 is a cross-sectional view of the output chute of FIG. 2 looking from line 3-3 of FIG. 2.
Figure 4:
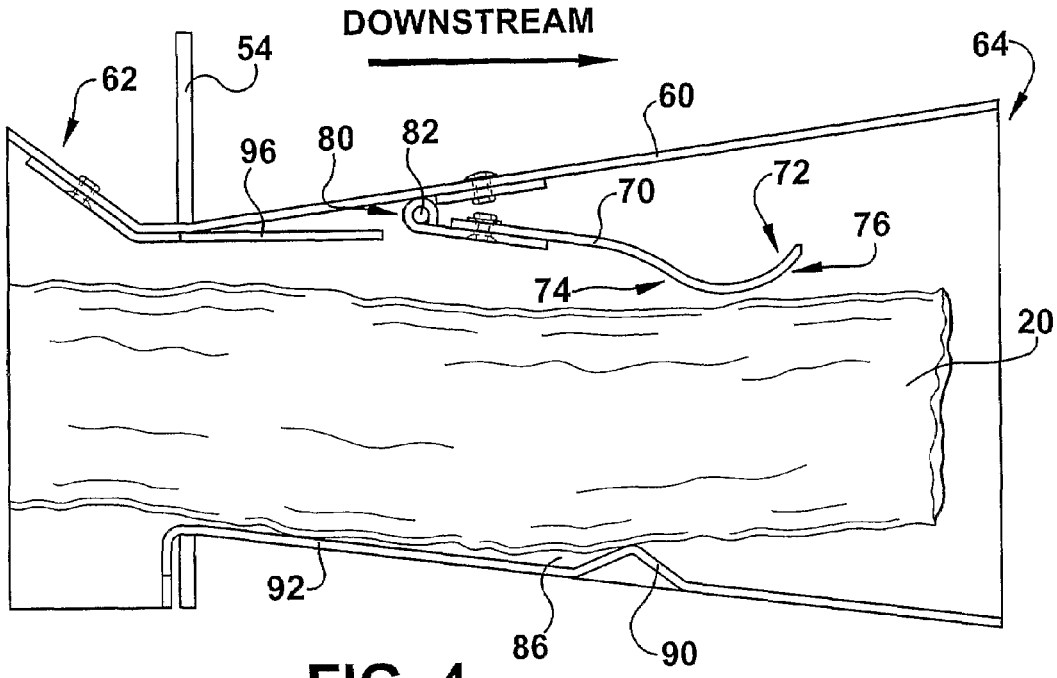
FIG. 4 is a cross-sectional view of the output chute of FIG. 3 with a strip of dunnage therein.

An exemplary output chute 60 for a dunnage converter 10 is shown in more detail in FIGS. 2-4. The output chute 60 generally has a rectangular cross-section that increases in at least one dimension from the upstream end 62 toward the downstream end 64 of the chute. The output chute is not limited to a rectangular cross-section, however. Other cross-sectional shapes may be used instead. The output chute 60 is mounted to the housing 54 enclosing the conversion assembly 16 (FIG. 1) to receive the strip of dunnage therefrom.

The output chute 60 also includes a guard 70 disposed in the chute 60. The guard 70 is movable between an open position (as shown in FIG. 4) allowing passage of a strip of dunnage 20 through the chute 60 and a closed position (as shown in FIG. 3) inhibiting access to the upstream end 62 of the chute from the downstream end 64 of the chute. The free end 72 of the guard 70 moves in a generally downstream direction when the guard 70 moves from the closed position to the open position. In the illustrated embodiment, the free end 72 of the guard 70 has both a forward glide surface 74 operative to glide along an outer surface of the strip of dunnage 20 (FIG. 4) as the strip moves in the downstream direction and a rearward glide surface 76 operative to glide along an outer surface of the strip of dunnage as the strip moves in an upstream direction opposite the downstream direction.

The illustrated guard 70 is in the form of a plate that extends from an upper, upstream portion of the chute 60 downwardly and downstream to a bottom sidewall. The illustrated guard is mounted to the upper portion of the chute 82 by a hinge element 80 for pivotable movement about a pivot axis 82. Although the pivot axis is fixed in the illustrated exemplary embodiment, a floating pivot axis can be employed within the scope of the present invention. A deflector 96 extends into the chute 60 upstream of the guard 70 to deflect the strip of dunnage away from the hinge element 80 and toward a center of the chute.

In the embodiment shown in FIGS. 2-4, the chute 60 includes an upstream-facing shoulder 84 that defines a recess 86 upstream of the shoulder 84 that allows the free end 72 of the guard 70 to move to a position where the rearward glide surface 76 is inaccessible from a downstream end 64 of the chute. In particular, a curb 90 projects into the chute 60 to form the shoulder 84 and the recess 86 on the upstream side of the curb. The curb 90 thus obstructs access to the free end 72 of the guard 70, making it difficult to move the guard from the closed position from a position downstream of the guard. In the illustrated embodiment the free end 72 of the guard 70 is removed from an edge of the curb 90 by about twenty-five hundredths of an inch (about six-tenths of a millimeter), a distance sufficient to allow the free end 72 of the guard 70 to swing freely from behind the curb 90.

When the guard 70 is in a closed position, where the free end 72 is adjacent the sidewall 92 of the chute 60, a downstream-most point of the upstream and downstream glide surfaces 74, 76 is inaccessible from a downstream end of the chute. When the guard 70 is in this closed position, the free end 72 of the guard is substantially parallel to the adjacent surface of the sidewall 92. The illustrated guard 70 also has a bend near the free end 72 that presents a concave surface to the downstream end 64 of the chute 60 and a convex surface to the upstream end 62 of the chute 60 when the guard 70 is in the closed position. Consequently, with the free end 72 of the guard 70 adjacent the surface of the chute 60, and behind the curb 90 in the recess 86, access to the free end 72 of the guard 70 from the downstream end 64 of the output chute 60 is difficult, if not impossible for all practical purposes. The guard 70 swings freely, however, in response to a strip of dunnage 20 entering the upstream end of the chute 60.

In the illustrated embodiment, the free end 72 of the guard has curved glide surfaces 74, 76 that engage the strip of dunnage 20 (FIG. 4) as the strip moves past the guard 70. The glide surfaces 74 and 76 ride on the strip of dunnage 20 whether the strip is moving forward in a downstream direction or in reverse, in an upstream direction. The rearward glide surface 76 in particular allows the dunnage strip 20 to move relative to the guard 70 without catching on the guard. As shown in FIG. 4, the bend in the guard 72 also helps to space the free end of the guard 72 from the strip of dunnage 20.

Figure 5:
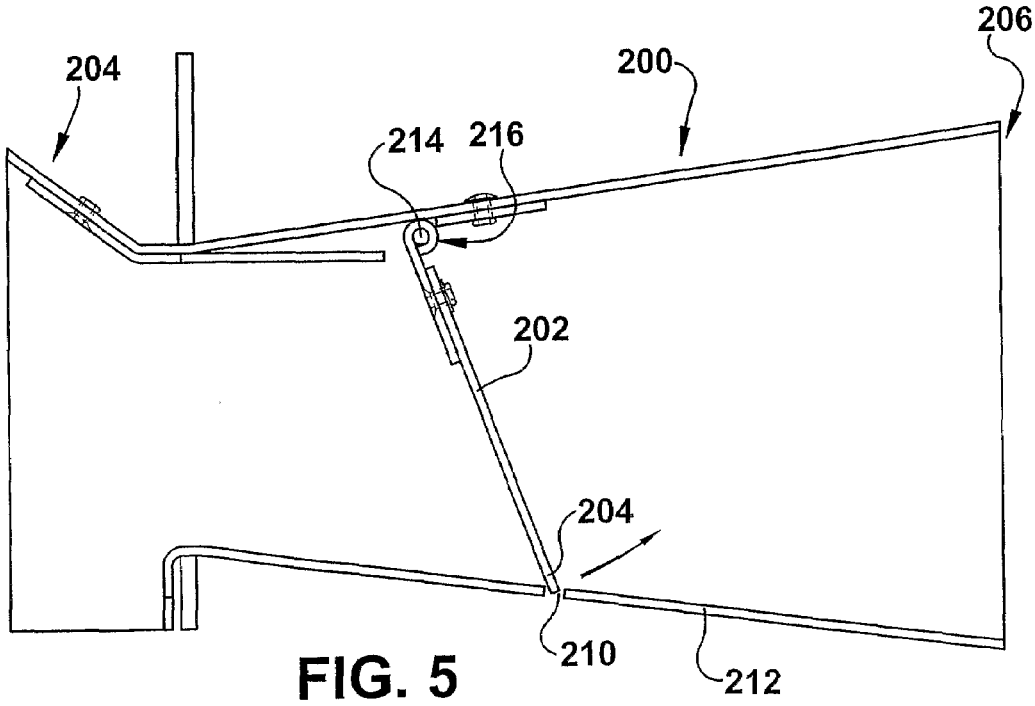
FIG. 5 is a cross-sectional view of another output chute embodiment as seen in a view that is similar to the view shown in FIG. 3.

Another embodiment of an output chute 200 for use with a converter in accordance with the invention is shown in FIG. 5. Like the chute 60, the output chute 200 includes a guard 202 and inhibits access to a free end 204 of the guard 202 when the guard 202 is in the closed position as shown. The guard 202 is movable between an open position allowing passage of a strip of dunnage through the chute 200 and a closed position inhibiting access to an upstream end 204 of the chute from a downstream end 206 of the chute. The free end 204 of the guard 202 is inaccessible from a downstream end 206 of the chute 200 when the guard 202 is in the closed position. In the illustrated embodiment, which is shown in the closed position, the free end 204 of the guard 202 extends into a recess 210 in a bottom sidewall 212 of the chute 200. The recess 210 is formed by a slot in the illustrated embodiment. As in the previous embodiment, the guard 202 is pivotally mounted to the chute 200 for movement about an axis 214 provided by a hinge element 216 mounted near an upper portion of the chute 200.

In this embodiment, the guard 202 is essentially a hinged plate whose distal end extends into the slot 210 in the bottom wall of the chute 200 when the guard is in a closed position. Because the end of the guard 202 pivots into the slot 210, it is difficult to lift the free end of the guard 202 out of the closed position from the downstream end of the chute 200. The guard 202 pivots out of the slot 210 freely, however, under pressure from a strip of dunnage advancing from the upstream direction. With this type of guard, the end of the strip generally is cut off before the converter is reversed to avoid any possibility that the end 204 of the guard 202 would catch on or tear the strip.

The present invention also provides a combination of an output chute and guard as described above for mounting to a converter for receipt of a strip of dunnage.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A dunnage converter, comprising:

a conversion assembly that converts a stock material into a strip of dunnage as the stock material passes therethrough in a downstream direction;

an output chute through which the strip of dunnage is discharged downstream of the conversion assembly; and a guard disposed in the chute and movable between an open position allowing passage of the strip of dunnage through the chute and a closed position inhibiting access to an upstream end of the chute from the downstream end of the chute, and the guard having at a free end both a forward glide surface operative to glide along an outer surface of the strip of dunnage as the strip moves in the downstream direction and a rearward glide surface operative to glide along an outer surface of the strip of dunnage as the strip moves in an upstream direction opposite the downstream direction wherein the chute includes an upstream-facing shoulder that defines a recess upstream of the shoulder, such that when the guard is in a closed position, the free end of the guard lies in the recess upstream of the shoulder, thereby making the rearward glide surface inaccessible from a downstream end of the chute.

2. A dunnage converter, comprising:

a conversion assembly that converts a stock material into a strip of dunnage as the stock material passes therethrough in a downstream direction;

an output chute through which the strip of dunnage is discharged downstream of the conversion assembly; and a guard disposed in the chute and movable between an open position allowing passage of the strip of dunnage through the chute and a closed position inhibiting access to an upstream end of the chute from the downstream end of the chute, and the guard having at a free end both a forward glide surface operative to glide along an outer surface of the strip of dunnage as the strip moves in the downstream direction and a rearward glide surface operative to glide along an outer surface of the strip of dunnage as the strip moves in an upstream direction opposite the downstream direction;

wherein the chute includes an upstream-facing shoulder that defines a recess upstream of the shoulder, such that when the guard is in a closed position, the free end of the guard lies in the recess upstream of the shoulder, thereby making the rearward glide surface inaccessible from a downstream end of the chute, wherein a curb projects into the chute to form the shoulder and the recess upstream of the curb.

3. A dunnage converter as set forth in claim 2, wherein when the guard is in a closed position where the free end is adjacent the sidewall of the chute, a downstream-most point of the upstream and downstream glide surfaces is inaccessible from a downstream end of the chute.

4. A dunnage converter as set forth in claim 2, wherein when the guard is in a closed position where the free end is adjacent the sidewall of the chute, the free end of the guard is substantially parallel to the adjacent surface of the sidewall.

5. A dunnage converter as set forth in claim 2, wherein the guard is pivotally mounted to the chute.

6. A dunnage converter as set forth in claim 5, wherein the guard pivots about an axis near an upper portion of the chute.

7. A dunnage converter as set forth in claim 6, wherein the guard mounts to the chute through a hinge element that provides the pivot axis.

8. A dunnage converter as set forth in claim 7, further comprising a deflector that extends into the chute upstream of the guard to deflect the strip of dunnage away from the hinge element and toward a center of the chute.

9. A dunnage converter as set forth in claim 2, wherein the free end of the guard has glide surfaces that form part of a convex surface on an upstream side of the guard when the guard is in the closed position.

10. A dunnage converter, comprising:

a conversion assembly that converts a stock material into a strip of dunnage as the stock material passes therethrough in a downstream direction;

an output chute through which the strip of dunnage is discharged downstream of the conversion assembly, the chute including a recess; and a guard disposed in the chute and movable between an open position allowing passage of the strip of dunnage through the chute and a closed position inhibiting access to an upstream end of the chute from the downstream end of the chute, the guard having a free end that extends into the recess when the guard is in the closed position and the free end extends substantially parallel to an adjacent surface of the chute when the guard is in the closed position;

wherein the chute has a shoulder that protrudes into the chute to define the recess upstream of the shoulder into which the free end of the guard extends in the closed position.

11. A dunnage converter as set forth in claim 10, wherein the guard is pivotally mounted to the chute.

12. A dunnage converter as set forth in claim 11, wherein the guard pivots about an axis near an upper portion of the chute.

13. A dunnage converter as set forth in claim 12, wherein the guard mounts to the chute through a hinge element that provides the pivot axis.

* * * * *